United States Patent [19]

Youssef

[11] Patent Number: 4,628,564

[45] Date of Patent: Dec. 16, 1986

[54] TOOTHBRUSH

[76] Inventor: Kamal A. Youssef, P.O. Box 6548, W. Palm Beach, Fla. 33405

[21] Appl. No.: 489,104

[22] Filed: Apr. 27, 1983

[51] Int. Cl.[4] ..... A46B 9/04

[52] U.S. Cl. ..... 15/167 R; 15/110; 15/244 R; 128/62 A

[58] Field of Search ..... 15/110, 167 R, 167 A, 15/114, 244 R, 244 C; 128/62 R, 62 A

[56] References Cited

U.S. PATENT DOCUMENTS

| | | | |
|---|---|---|---|
| 2,133,805 | 10/1938 | Brown | 15/244 B |
| 2,555,858 | 6/1951 | Oleksy | 15/244 R |
| 2,570,596 | 10/1951 | Ross | 15/244 R X |
| 2,819,482 | 1/1958 | Applegate | 15/110 |
| 2,906,643 | 9/1959 | Dennis | 15/244 R X |
| 3,146,478 | 9/1964 | Rosenthal | 15/110 |
| 3,337,893 | 8/1967 | Fine et al. | 15/114 X |

FOREIGN PATENT DOCUMENTS

| | | | |
|---|---|---|---|
| 443523 | 3/1936 | United Kingdom | 15/244 R |

*Primary Examiner*—Peter Feldman

[57] ABSTRACT

A toothbrush with a liquid-storing sponge structure formed with a thickness diminishing to a pointed head which projects outwardly longitudinally from the bristle head. The sponge structure is in contacting engagement with the bristles whereby the stored liquid may be introduced into and along the rows of bristles. The sponge structure carries more liquid than the bristles alone and thereby generates a cleansing foam to the teeth.

4 Claims, 21 Drawing Figures

1C
2C
3C
4C
50
60
70
80
90

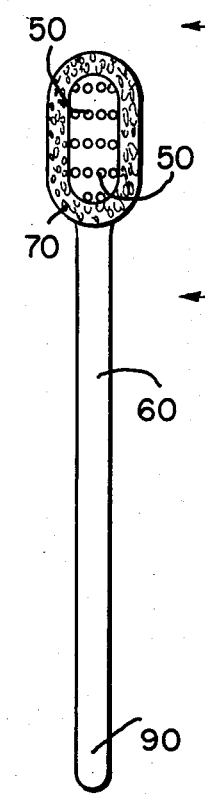
FIG. 5A
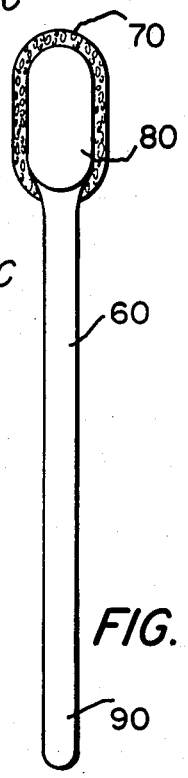
FIG. 5B
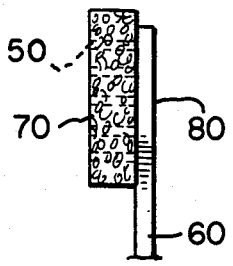
FIG. 5C
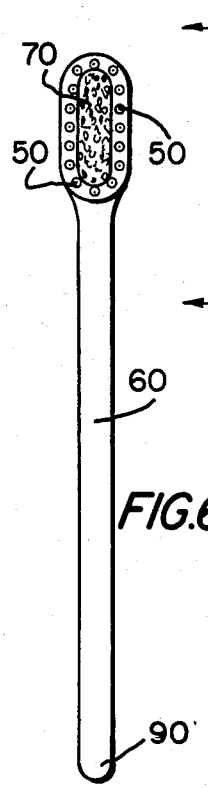
FIG.6A
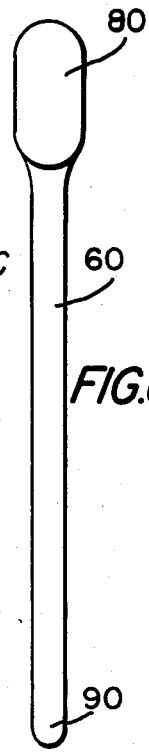
FIG.6B
FIG.7A
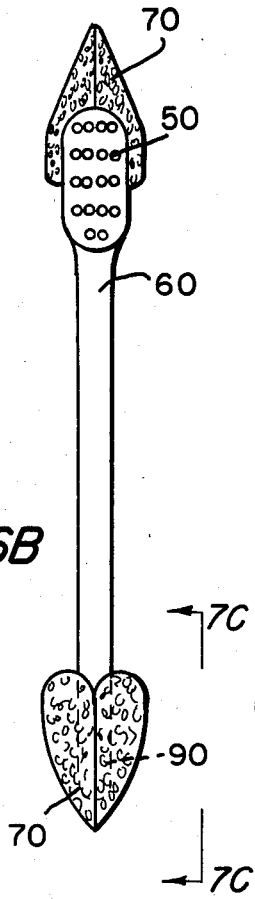
FIG. 7B
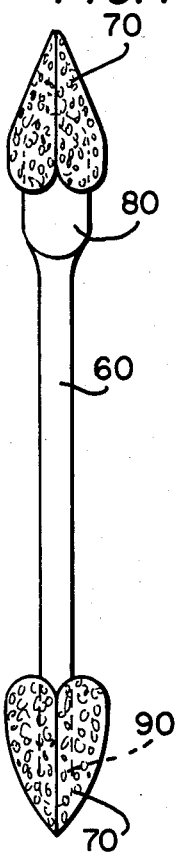
FIG. 6C
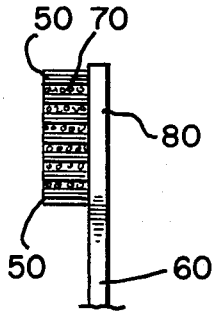
FIG. 7C
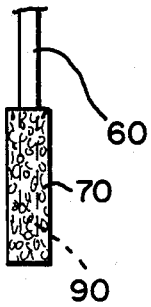

TOOTHBRUSH

BACKGROUND OF THE INVENTION

This is a continuation-in-part of my co-pending application Ser. No. 451,978 filed Dec. 21, 1982 entitled ToothSticks "TooStix". Water is of paramount importance in most cleaning processes and cleaning the teeth (Oral hygiene in general) is no exception. The "Classical toothbrush" being poorly or totally "non-absorbent" is incapable of carrying or conveying into the mouth cavity any amounts of water worth mentioning (especially in comparison with the current invention). This too small an amount of water carried by the regular toothbrush results in substantially limiting the cleaning ability or potential of the conventional toothbrush. Furthermore, the bristle design of the classical toothbrush is incapable of generating copious amounts of "cleansing foam" during the process of brushing the teeth, even in the presence of sufficient amount of water and despite the fact that the vast majority (there are, however, a few exceptions such as Pearl Drops ®) of toothpastes and "Dentifrices" contain substantial amounts of foaming agents and ingredients such as sodium lauryl sulfate and detergents. Foam or suds is invaluable in cleaning in general, on account of its effective and huge surface area, its high dirt-emulsifying/lifting and anti-sticking power on pigments, food particles, debris, "plaque" . . . etc. Another design limitation of the regular toothbrush stems from the mechanical difficulty or disadvantage in brushing properly (up and down) of the back teeth. A third disadvantage of "classical" toothbrushes in being too abrasive to delicate and tender gum tissues because of the sharp and pointed ends of the bristles.

BRIEF DESCRIPTION OF THE DRAWINGS

FIG. 1-A: shows a front view of a toothbrush constructed in accordance with my invention.

FIG. 1-B: shows a back view thereof.

FIG. 2-A: shows a front view of an alternative embodiment of my invention.

FIG. 2-B: shows a back view thereof.

FIG. 3-A: shows a front view of another alternative embodiment of my invention.

FIG. 3-B: shows a back view thereof.

FIG. 4-A: shows front view of another alternative embodiment of my invention.

FIG. 4-B: shows a back view thereof.

FIG. 5-A: shows a front view of another alternative embodiment of my invention.

FIG. 5-B: shows a back view thereof.

FIG. 5C shows a side view thereof.

FIG. 6-A: shows a front view of another alternative embodiment of my invention.

FIG. 6-B: shows a back view thereof.

FIG. 6C shows a side view thereof.

FIG. 7-A: shows a front view of another alternative embodiment of my invention.

FIG. 7-B: shows a back view thereof.

FIG. 7-C: shows a side view thereof.

DESCRIPTION OF THE PREFERRED EMBODIMENTS OF THE INVENTION

Figures 1A, 1B, 1C, 2A, 2B, 2C, 3A, 3B, 3C, 4A, 4B, 4C:
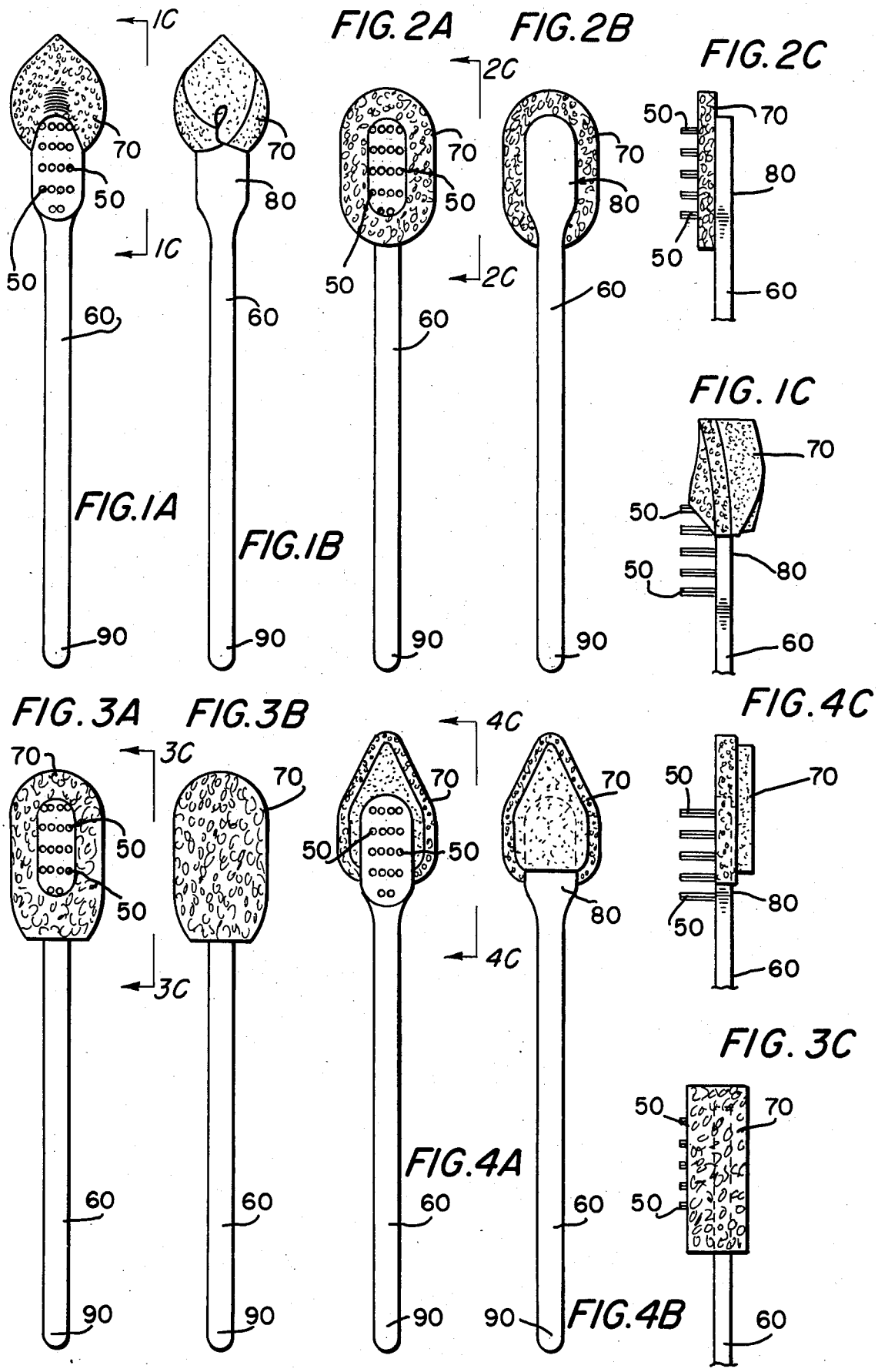
FIG. 1C shows a side view thereof.
FIG. 2C shows a side view thereof.
FIG. 3C shows a side view thereof.
FIG. 4C shows a side view thereof.

Turning to FIG. 1-A which shows a front view of the the toothbrush of my invention with 3-rows of bristles 50 which may be soft, medium, firm or hard with handle 60 and fibrous/fibrocellular "conical" or "pyramidal" spongy structure 70 glued onto the tip, sides & back of the head of the toothbrush. FIG. 1-B shows a back-view of my hybrid toothbrush where 80 presents the back of the "Head" and the back of the sponge structure 70 glued onto the tip, sides and back of the "Head" 80, also shown: Handle 60 and Handle-end 90. Turning to FIG. 2-A, it shows a front view of an alternate embodiment of my toothbrush with 3 rows of bristles 50 which may be soft, medium, firm or hard and glued-on Foam 70 encircling the entire Head 80, also shows handle 60 and Handle-end 90 of the toothbrush.

FIG. 2-B: shows a view of the back of my toothbrush, back of head 80 and back of handle 60 and back part of glued-on foam 70 and handle-end 90.

Turning to FIG. 3-A which shows front-view of another alternative embodiment of my toothbrush with 3-rows of bristles 50 which may be soft, medium, firm or hard and front view of handle 60 and glued-on foam 70 encircling completely the 3-rows of bristles and handle-end 90.

FIG. 3-B: shows a back view of my toothbrush with glued-on Foam 70 covering entirely the back of "head" of the brush 80. Also shown is back of the handle 60 and handle-end 90.

Turning to FIG. 4-A: shows a view of the front of another alternative embodiment of my toothbrush with 3-rows of bristles 50 which may be soft, medium, firm or hard and multiple Rainbow-colored laminated and conically shaped glued-on foam 70 and front view of handle 60 and handle-end 90.

FIG. 4-B: shows a view of the back of my toothbrush with multi-layered rainbow-colored and glued-on foam covering upper two thirds of the back of the head of the brush 80 and a back-view of the handle 60 and handle-end 90.

FIG. 5-A: shows a front view of another alternative embodiment of my toothbrush with essentially two rows of bristles 50 and contiguous glued-on foam 70 with handle 60 and handle-end 90.

FIG. 5-B: shows a back-view of my toothbrush with back of head 80 and back of "glued-on" foam 70 and back of handle 60 and handle-end 90.

FIG. 6-A: shows a front view of another alternative embodiment of my foam toothbrush with circumference-oriented one row of bristles 50 completely surrounding glued-on foam 70 and handle 60 and handle-end 90.

FIG. 6-B: shows back-view of my foam toothbrush with back of head 80 and back of handle 60 and handle-end 90.

FIG. 7-A: shows a front view of another embodiment of my toothbrush where three rows of bristles 50 and glued-on conical sponge 70, Handle 60 and Handle-end 90.

FIG. 7-B: shows back view of a toothbrush with the back of head 80 and the back of sponge 70 glued onto sides and tip of handle 60 and handle-end 90.

FIG. 7-C: shows a side view of Handle 60 and Handle-end 90 of a foam toothbrush with the glued-on appendage 70/70. The side views (FIGS. 1C–6C) are illustrated to show the positions of the glued-on foamappendages 70 respectively and in relation to the bristle head 80 (or Bristles-free tail-end 90 in case of FIG. 7-C) of the Foam-toothbrush and more importantly in relation to the brushing-bristles 50 which enjoy total freedom from the foam, except in the embodiments of FIGS. 5 and 6. In operation, the toothbrushes of FIGS: 1A, 1B, 1C; or 4A, 4B, 4C (for example) are wetted well with warm (or tepid) water, then the toothpaste is applied to the bristles 50 and the sponge head 70, the latter providing an extra and highly absorbent area for securing an extra amount of toothpaste/gel. The toothbrush is then introduced into the mouth and brushing commenced preferably with the mouth closed. It will be felt that the brushing-bristles fit much more snugly against the back-teeth in particular. In addition to the copious amounts of foam, generated-in-excess, for two reasons: 1st the significant amount of water carried on the sponge head 70. This water contributes substantially to the build-up of foam. Additionally, the fibro-cellular design with the trapped air bubbles (constitutes 97% of the sponge actually), strongly promotes the generation of foam further. This extra foam which can be 4–5 times greater in quantity and better in cleaning quality than otherwise, bathes, so-to-speak, the teeth, gums and mouth cavity in general. Toothpastes/gels seem somehow to taste better when in the "Foam state" than in solution, a situation comparable to a solution of candy before and after being transformed into cotton candy, the latter being in the foam state tastes much better than in solution (although both solution and foam are chemically identical). The bad or "unpleasant" taste of toothpaste seems to be much milder, less unpleasant and "mediciny" in the foam state than in solution. In addition, the higher water content of the foam generated by the Foam toothbrushes contributes to this mildness by diluting, so-to-speak, the bed or "bitter" taste of the toothpastes. Furthermore, the higher water content enhances the flow and penetration of the toothpaste/gel into otherwise inaccessible areas in the mouth cavity, such as in between the teeth, cracks and crevices . . . etc. This contributes to better cleaning of "all" tooth-surfaces and minimizes the buildup of ∓plaque" material and lessens significantly the chances of developing cavities and tooth decay in general. The milder taste of the toothpastes/gels in the "foam-state" definitely encourages more brushing and lessens the common "hate" or "phobia" associated with brushing and toothpastes in general, especially by children and young adults. Furthermore, foam-having more body to it-seems to have a protective or cushioning effect on the gums against the often sharp, abrasive and pointed ends of the bristles of the toothbrush.

The toothbrushes of FIGS. 2A, 2B, 2C; 3A, 3B, 3C; and 6A, 6B, 6C are operated in essentially the same manner as the toothbrushes of FIGS. 1A, 1B, 1C; and 4A, 4B, 4C except that the former models, particularly the model of FIGS. 2A, 2B, 2C feel quite differently in the mouth. The "CORONA" toothbrush of FIGS. 2A, 2B, 2C feels the "closest" to the regular toothbrush & moves freely in the mouth, while the toothbrush of FIGS. 3A, 3B, 3C is perhaps the bulkiest of the six models and the brush seems to fit quite snugly against the teeth (especially the back teeth). It will be noticed in brushing with the toothbrushes of FIGS. 1A, 1B, 1C; 3A, 3B, 3C; or 4A, 4B, 4C, that the cheek muscles, for the first time, are actively engaged in the toothbrushing process, contributing further towards a more vigorous and thorough cleaning or brushing of the teeth in general and the back teeth in particular. It is important to mention here that the back teeth are notoriously more vulnerable and susceptible to tooth decay and developing more and bigger cavities than the front teeth in general.

The Foam "tail" 77 of FIG. 7-A, can be used for massaging (with or without toothpastes/gels) and even cleaning and "brushing" and "stimulating" the gums and teeth of people with delicate, inflammed, painful and tender or bleeding or "diseased" gums, referred to as "Periodontal diseases" by Dentists. If the "Periodontal" or gum condition persists, it may be advisable to switch to the bristle free foam only toothbrushes; subject of a co-pending patent application, mentioned above.

It is understood that variations could be made on the embodiments described herein, without departing from the essential features of the invention and the preferred embodiments are not intended to limit the spirit or scope of the invention as set forth in the appended claims, thus:

I claim:

1. A toothbrush, comprising:

a handle;

a bristle-supporting head at one end of said handle;

elongate rows of bristles fixed in, and extending from, said head; and means for storing liquid fixed to said head; wherein all bristles of said rows thereof have only single ends thereof fixed against movement, said ends being fixed in said head, remaining lengths of said bristles being in free projection from said head; and said liquid-storing means is fixed to said head, and is set astride and in contacting engagement with first ends of said rows of bristles, whereby liquid stored by said means may be introduced into and along said rows said liquid-storing means comprises a resiliently compliant and absorbent material, said material being formed with a thickness diminishing to a pointed end which projects outwardly longitudinally from said head.

2. A toothbrush, according to claim 1, wherein:

said liquid-storing means is enwrapped about said first ends of said rows of bristles.

3. A toothbrush, according to claim 1, wherein:

a portion of said material is raised in elevation and buttresses said first ends of said rows of bristles.

4. A toothbrush, according to claim 1, wherein:

said head has a given width; and said material has a width greater than said given width.

* * * * *